US006363580B1

(12) United States Patent
Sørensen et al.

(10) Patent No.: US 6,363,580 B1
(45) Date of Patent: Apr. 2, 2002

(54) SIFTING NET FOR A FIBER DISTRIBUTOR

(75) Inventors: Birger Elmgaard Sørensen, Vejle; Jens Ole Bröchner, Skanderborg, both of (DK)

(73) Assignee: M & J Fibretech A/S, Horsens (DK)

( * ) Notice: Subject to any disclaimer, the term of this patent is extended or adjusted under 35 U.S.C. 154(b) by 0 days.

(21) Appl. No.: 09/688,543

(22) Filed: Oct. 16, 2000

Related U.S. Application Data

(63) Continuation of application No. PCT/DK99/00221, filed on Apr. 20, 1999.

(30) Foreign Application Priority Data

Apr. 21, 1998 (DK) ..... 0555/98

(51) Int. Cl.[7] ..... D01G 25/00
(52) U.S. Cl. ..... 19/296; 19/304
(58) Field of Search ..... 19/296, 301, 303, 19/304, 305, 306; 162/251; 198/689.1; 264/121, 518; 425/82.1, 80.1, 83.1, 363, 373

(56) References Cited

U.S. PATENT DOCUMENTS

| | | | | | |
|---|---|---|---|---|---|
| 3,581,706 | A | * | 6/1971 | Rasmussen | 118/312 |
| 3,748,693 | A | | 7/1973 | Jepersen | 19/156.3 |
| 3,973,291 | A | * | 8/1976 | Kolbach | 19/296 |
| 4,060,360 | A | * | 11/1977 | Tapp | 19/296 |
| 4,074,393 | A | | 2/1978 | Hicklin et al. | 19/303 |
| 4,112,549 | A | * | 9/1978 | Min et al. | 19/304 |
| 4,264,289 | A | * | 4/1981 | Day | 425/83.1 |
| 4,278,113 | A | * | 7/1981 | Persson | 19/304 |
| 4,335,066 | A | | 6/1982 | Dinius | 264/121 |
| 4,351,793 | A | * | 9/1982 | Day | 264/518 |
| 4,640,810 | A | | 2/1987 | Laursen et al. | 264/518 |
| 4,650,409 | A | * | 3/1987 | Nistri et al. | 19/304 |
| 4,686,342 | A | * | 8/1987 | Collier et al. | 219/58 |
| 5,234,550 | A | | 8/1993 | Ekholm et al. | 162/251 |
| 5,471,712 | A | | 12/1995 | Kroyer | 19/304 |
| 5,628,090 | A | * | 5/1997 | Lock | 19/304 |

FOREIGN PATENT DOCUMENTS

| | | |
|---|---|---|
| EP | 0 226 939 A2 | 9/1986 |
| SE | 433860 B | 6/1984 |
| SE | 437041 B | 2/1985 |

* cited by examiner

*Primary Examiner*—John J. Calvert
*Assistant Examiner*—Gary L. Welch
(74) *Attorney, Agent, or Firm*—Pennie & Edmonds LLP

(57) ABSTRACT

A fiber distributor for forming an air-laid fiber web on a running endless forming wire which, during operation, in principle is horizontal. The fiber distributor includes a suction unit positioned under the forming wire, a housing positioned above the forming wire and having at least one combined fiber and air inlet, and a base having a number of flow openings, and a number of rotational wings positioned above this base. These wings distribute the fibers along the upper side of the base. The base is designed as a grid with grid bars which taper in a downwards direction. In the flow openings of the grid, a slip is advantageously formed which prevents the fibers from packing together and blocking the openings during operation. The fiber distributor is thus, at a continuous high capacity and is able to form an even and homogenous fiber layer on the forming wire.

20 Claims, 3 Drawing Sheets

SIFTING NET FOR A FIBER DISTRIBUTOR

CROSS-REFERENCE TO RELATED APPLICATIONS

This application is a continuation of the U.S. national stage designation of International Application PCT/DK99/00221, filed Apr. 20, 1999.

FIELD OF THE INVENTION

The present invention relates to a fiber distributor for forming an air-laid fiber web on a running endless forming wire comprising a suction unit positioned under the forming wire, a housing positioned above the forming wire, and having at least one fiber inlet, and an improved base having a number of flow openings defined by partitions which diverge in a downward direction, and a number of rotational wings positioned above this base for distributing the fibers along the upper side of the base.

BACKGROUND ART

Fiber distributors of the types disclosed herein are used extensively in systems where the fiber layer on the forming wire is subsequently subjected to a number of processes which convert the fiber layer to a continuous web in the form of, for example, paper and synthetic paper materials of the kind typically used for the production of various paper products and hygienic articles.

The fibers are fed into the fiber housing through the fiber inlet and are driven in a flow over the upper side of the base by the wings which, during operation, rotate in such a way that the fibers are evenly distributed over the total area of the base.

At the same time, the suction unit generates an air flow through the openings in the base and the forming wire. This air flow successively pulls fibers with it down through the openings in the base. As the openings in the forming wire are smaller in size than the openings in the base, the majority of these fibers lie in a desiredly even layer on the upper side of the forming wire, or on a fiber layer formed in advance on the forming wire. The forming wire continuously carries the fiber layer on to the following processes mentioned above.

The base conventionally comprises a net with a quadratic mesh. When the fibers comprise of, or contain, short cellulose fibers, the mesh must be dimensioned with a correspondingly small mesh aperture. A fiber distributor such as this therefore has a comparatively small capacity.

One proposal to solve this problem is disclosed in U.S. Pat. No. 4,355,066. This patent describes a fiber distributor for forming short-fibered cellulose pulp on a forming wire via a rectangularly meshed base net. Thus, each flow opening in this known base net has both a small and a large dimension, which means that the flow area of the individual flow openings and thus the capacity of the net is increased correspondingly.

Certain characteristics of the fiber distributor and of the fibers themselves make designing an ideal base net difficult. The base net must be able to withstand the differential pressure generated by the suction unit. This means that the thread of the base net must have a suitable thickness in order to resist the resulting comparatively large load. Additionally, for reasons of economy and strength, a mixture of cheap cellulose fibers and more expensive, but longer synthetic fibers are often used to produce fiber web.

It has become apparent that when using the rectangularly meshed net mentioned in U.S. Pat. No. 4,355,066 with a sufficiently thick base net thread, the short and long fibers become stuck and block the net openings when passing through the narrow gap between the thick thread of this net. The long synthetic fibers also tend to get wound up in the thread of the net. This means that the fiber distributor is periodically out-of-service, and that the structure of the fiber layer on the forming wire is very uneven.

European Patent EP-A-0 226 939 concerns an apparatus for forming fibrous webs with advances consisting of controlled formation of light and heavy fluff zones and improved gas flow regulation. The patent describes a fiber distributor which has a flow channel housing for depositing the fibers onto an upstream surface of a forming wire which is located on an outer peripheral rim section of a cylindrical drum assembly. One of the embodiments contains a inner drum ring or attenuating layer with a number of small openings which could be small tapering or conical bores similar to those described in the instant patent. The only purpose of this attenuating layer is to diminishing the pressure differential exerted on the forming surface of the forming wire from a vacuum from a central vacuum duct. Therefore, the small bores will, of necessity, only occupy a limited part of the total area of the attenuating layer and is inapplicable to a forming wire.

The present invention now provides an improved fiber distributor which overcomes the shortcomings of the prior art.

SUMMARY OF THE INVENTION

The present invention relates to a fiber distributor for forming an air-laid fiber web on a running endless forming wire which, during operation, preferably is horizontal, comprising a suction unit positioned under the forming wire, a housing positioned above the forming wire and having at least one fiber inlet, and a base having a number of flow openings, and a number of rotational wings positioned above this base for distributing the fibers along the upper side of the base, wherein the base is designed with flow opening defined by partitions which diverge in a downwards direction.

Advantageously, the two opposite partitions in a flow opening preferentially form an angle of between 5 and 35° and more preferentially between 10 and 25°. Also, each opening typically has a quadratic or rectangular area. Preferably, two of the opposite sides of each opening are extending mainly parallel with the transport direction of the forming wire. Alternatively, two of the opposite sides of each opening forms an angle with the transport direction of the forming wire.

The base is preferably a grid having grid bars, each having two sides converging in a downwards direction and each forming a partition in a flow opening. Advantageously, the height of each grid bar is between 1 and 5 times greater than its width at the upper side of the grid. Typically, the crossed grid bars are joined at cross points by welding or soldering, and the base is coated with a fluorocarbon such as Teflon.

BRIEF DESCRIPTION OF THE DRAWING FIGURES

Preferred features of the invention are disclosed herein in the following detailed description which is to be reviewed in connection with the appended drawings wherein.

DETAILED DESCRIPTION OF THE INVENTION

In this description, it is presumed that the fiber distributor according to the invention belongs to a system which produces paper web in the form of paper and synthetic paper materials of the kind typically used for various paper products and hygienic articles.

The present invention provides a new and improved fiber distributor which, even with a mixture of short and long fibers and at high capacity, can consistently form a more even and homogenous fiber layer on the forming wire than is possible today.

Figure 4:
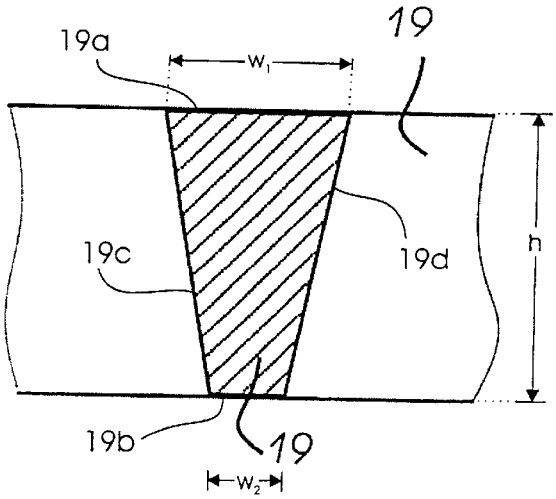
FIG. 4 is a cross-sectional view of a grid bar for the base grid in FIG. 3.

The novel and unique features according to the invention whereby this is achieved is the fact that the flow openings of the base are defined by partitions which diverge in a downwards direction as best seen in FIG. 4. The consequent slip created in the openings of the base thus efficiently prevents the fibers from becoming stuck.

Each opening can, for example, have a quadratic or rectangular area. In both cases, the same considerable advantage can be obtained, in that the fibers do not get caught and do not block the openings.

Depending on the structure which the resulting fiber web is to have, and the character of the fibers used, two opposite sides of each of the openings can extend in the same direction as the transport direction of the forming wire or can, alternatively, form an angle to the forming wire.

Figure 1:
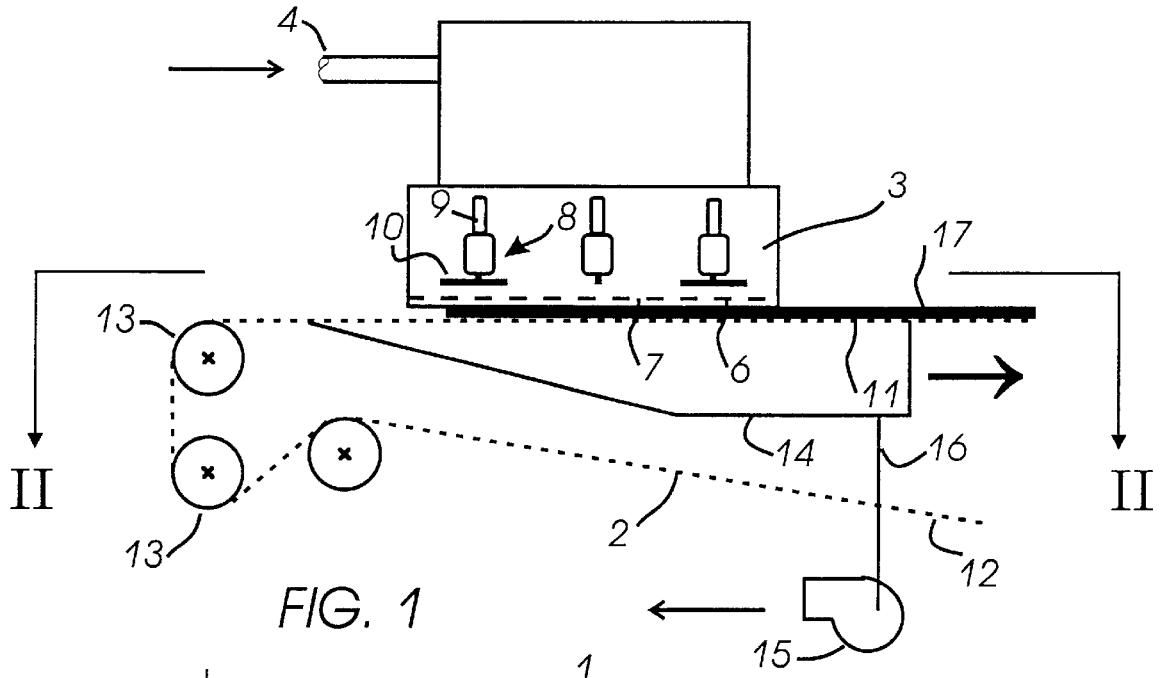
FIG. 1 is a diagrammatic side elevational view of a fiber distributor according to the invention which is placed over a partially shown forming wire.

As shown in FIG. 1, fiber enters though combined fiber and air inlet 4 into fiber distributor housing 3. The distributor housing contains a base 6 with evenly distributed flow openings 7. In the example shown, there are three rows of rotors 8 positioned above the base. In each row, there are eight rotors, each comprising a rotational vertical shaft 9 with a lower wing 10. During operation, the rotors are rotated via a drive unit (not shown).

Only the front end of forming wire 2 is shown. During operation, this runs with an upper wire part 11 and a lower wire part 12 over roller 13 in the direction indicated by the arrow. The upper path of the forming wire transports the formed fiber layer 17. The forming wire comprises a net with a mesh which is fine enough to prevent a substantial amount of the fiber from passing through.

A suction box 14 is positioned under the upper wire part of the forming wire. A vacuum pump 15 sucks air from this via an air conduit 16.

Figure 2:
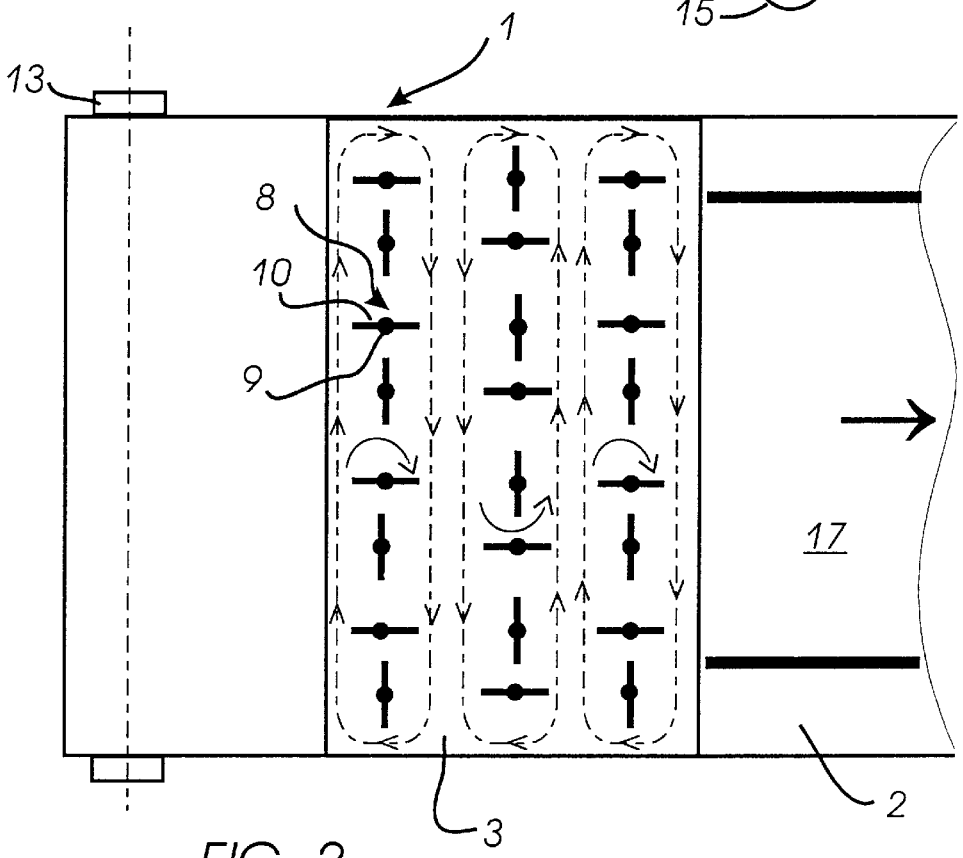
FIG. 2 is a plan view of the fiber distributor shown in FIG. 1.

In FIGS. 1 and 2, the fiber distributor is placed at a comparatively short distance above a forming wire which is part of the system and the system is running in a horizontal configuration.

When the system is in operation, the vacuum pump generates a negative pressure in the suction box. The negative pressure is transmitted via the mesh in the upper wire part of the forming wire, and the openings of the base to the housing. From here, fiber and air are sucked into the housing via the combined fiber and air inlet. The air continues in a flow through the openings of the base and the mesh of the forming wire down to suction box.

The rotors set the fibers in flow across the upper side of base, along the paths indicated by the dotted lines in FIG. 1. Thus, the fibers are distributed evenly over the total area of the base.

Figure 3:
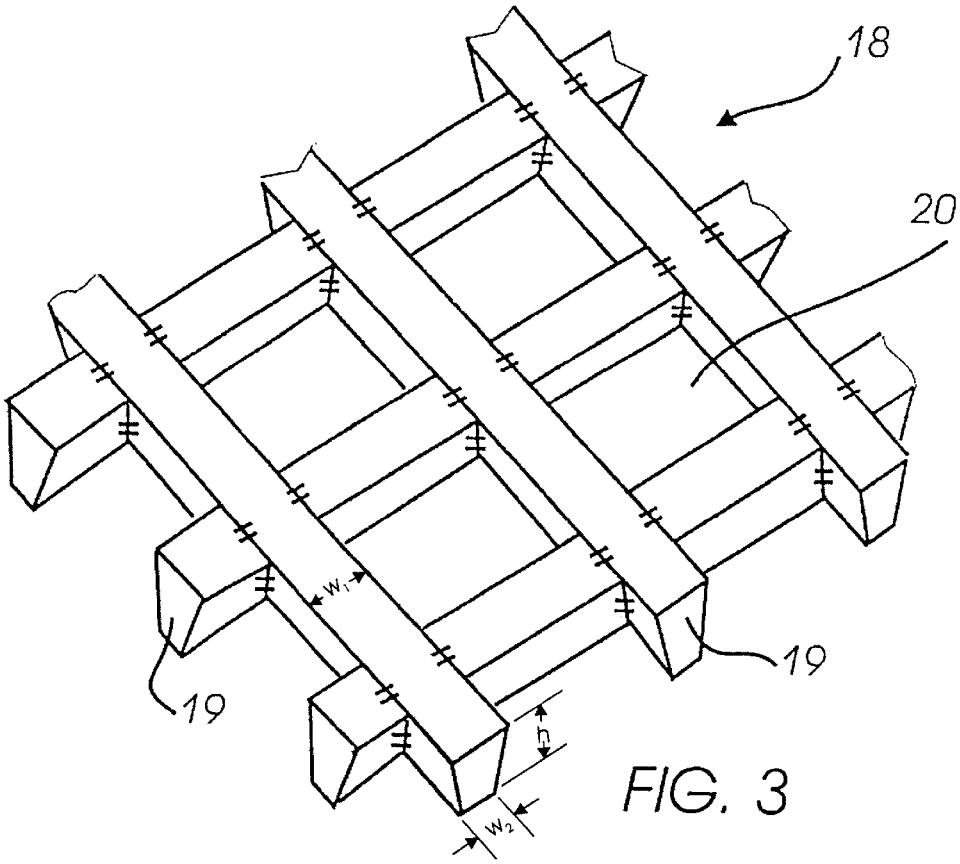
FIG. 3 is a perspective plan view of a fragment of the fiber distributor base grid illustrated in FIGS. 1 and 2.

In FIG. 3, the fiber distribution base is in the form of a grid 18 which is welded together of crossed grid bars 19. These define the flow openings 20. The air flow through the openings of the base successively rakes some of the fibers which run in flows along the upper side of the base down onto the forming wire, where the majority of the fibers remain because they are not able to penetrate the fine mesh of the forming wire. The upper path of the forming wire transports the formed fiber layer further in the direction of the arrow for treatment in the following process stages of the system.

The grid bars of the fiber distributor must have sufficient resisting moment against bending in order to ensure that the grid in its entirety is strong enough to absorb load from the differential pressure over the grid which has been formed by the vacuum pump. In order to maintain the capacity of the fiber distributor at the required high level, the bars must be comparatively narrow so that they do not block too much of the total flow area of the grid. As the grid bars must have a comparatively large resisting moment, it is necessary for the bars to be comparatively tall.

FIG. 4 shows an embodiment according to the invention where all of the grid bars 21 are coated with, for example, Teflon 22. This is to reduce the friction coefficient of the surface and also to smooth over any irregularities at e.g. the welds in the comers between the crossed bars.

Figure 6:
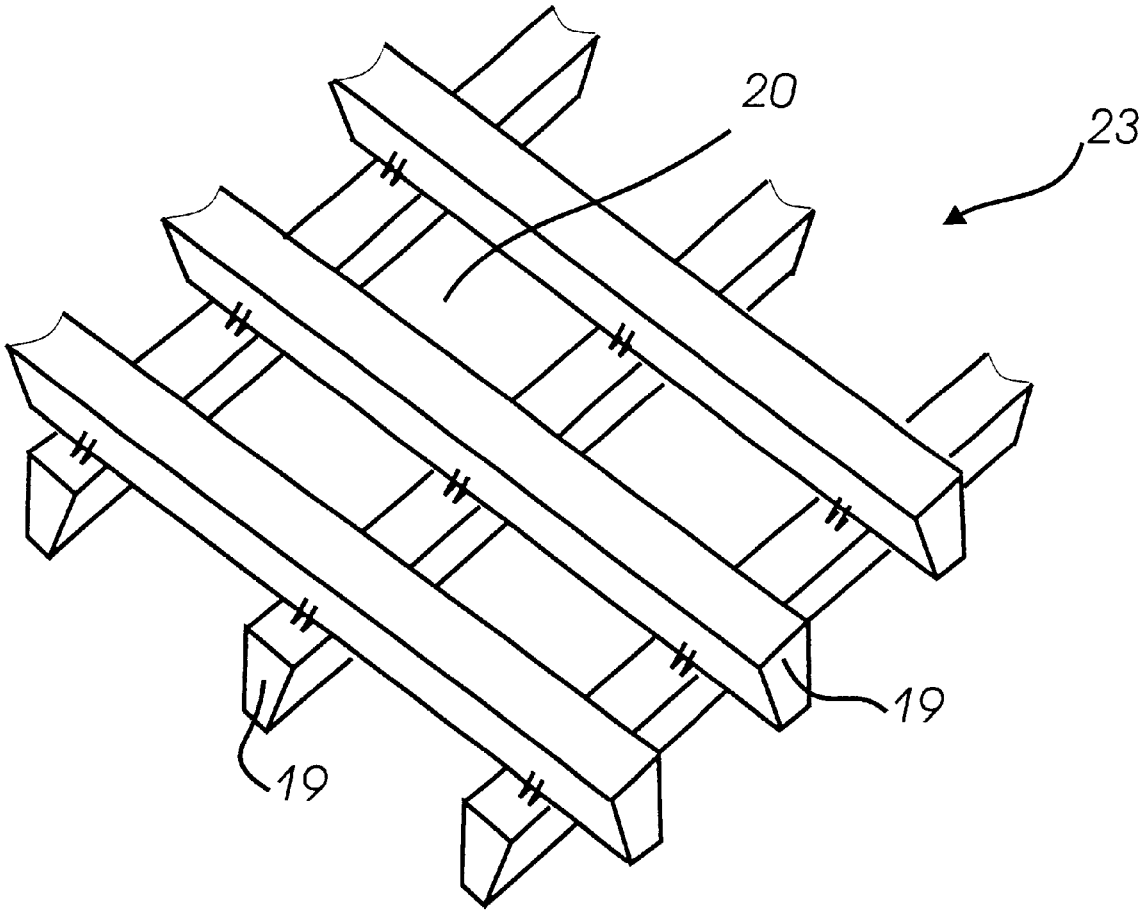
FIG. 6 shows a second embodiment of a base grid according to the invention.

The grid 23 of FIG. 6 shows a variation of the embodiment 18 shown in FIG. 3. Here, the same grid bars 19 are used but in this case, they are placed above each other. With this design, the grid bars are easy to join together with spot welding. This design is especially suitable for grids having rectangular openings.

The flow openings therefore have the appearance of channels which the fibers must force on their passing between the upper and lower side of the grid. The fibers tend to pack and block ordinary channel-shaped flow openings. As shown in FIG. 4, each grid bar in the present invention tapers in a downwards direction so that a slip is formed in the channel-shaped flow openings. This prevents the fibers from packing.

The two sides of the bars preferentially form a mutual angle of between 5 and 35° and more preferentially between 10 and 25°. This provides a good slip and at the same time a strong bar.

A strong bar which, at the same time, blocks the flow area of the grid as little as possible, is also obtained in that the height h of the bar is between 1 and 5 times greater than its width w1 at the upper side of the grid. The advantage of such a narrow and tall grid bar profile is that it is impossible or at least very difficult for the long synthetic fibers to become entangled in the openings delimited by the bars.

As seen in FIG. 4, each grid bar 19 preferably has a trapezoidal cross-section and is provided with substantially parallel upper 19*a* and lower sides 19*a*, 19*b*, respectively. The upper side 19*a* has a width w1 which is greater than the width w2 of the corresponding lower side 19*b*. The upper 19*a* and lower 19*b* sides are connnected by a pair of sidewalls 19*c*, 19*d* which taper in a downward direction.

This arrangement results in the flow openings 20 increasing in cross-sectional area in a downward direction through a thickness of the base, as seen in FIG. 3.

Figure 5:
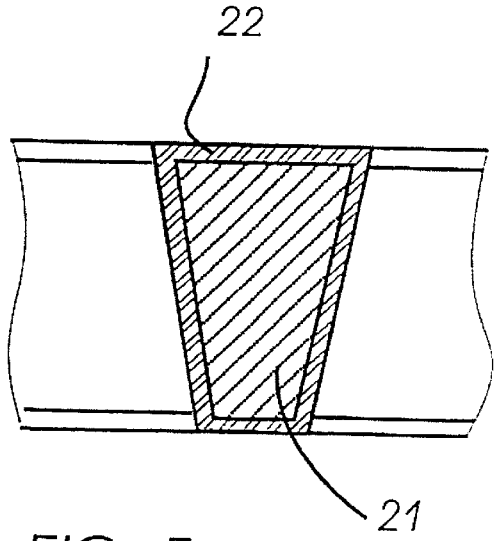
FIG. 5 shows the same grid bar of FIG. 4, but with a coated surface.

In an especially advantageous embodiment, the base of the fiber distributor can be formed as a grid with grid bars, each grid bar having two sides which converge in a downwards direction and which each forms a partition in a flow opening. Such a grid can easily have sufficient strength to resist load from the differential pressure which the suction unit generates over the grid. The slip in the grid occurs because the grid bars, seen in the cross-section in FIGS. 4 and 5, are tapered from the upper side of the grid to the under side of the grid.

The grid of the invention can expediently be produced with crossed grid bars joined at the comers of the openings by, for example, welding or soldering. Such joins can easily cause irregularities in the surface in which the fibers can become stuck. In order to eliminate this risk, the grid can be coated with, for example, Teflon. This Teflon will not only cover these irregularities but will also give the grid an even and smooth surface having a very low friction coefficient.

Thus, the considerable advantage is furthermore obtained in that the fibers will flow more easily over the upper side of the grid, thus improving distribution along this surface. The fibers will also be distributed more evenly. At the same time, the fibers will meet a minimum of resistance during their passage through the grid openings.

It should be noted that the same advantage can be achieved by coating a base which is not shaped like a grid, and that the openings do not necessarily have to be quadratic or rectangular but could just as well have any other suitable shape, for example, they could be rhombic.

What is claimed is:

1. A fiber distributor for forming an air-laid fiber web on a running endless forming wire comprising:

a suction unit positioned under the forming wire, a housing positioned above the forming wire and having at least one fiber inlet, a base having a number of flow openings, and a number of rotational wings positioned above this base for distributing the fibers along the upper side of the base, wherein the base is designed with flow openings defined by partitions which diverge in a downwards direction such that the flow openings increase in cross-sectional area in the downwards direction through a thickness of the base.

2. A fiber distributor according to claim 1, in which, during operation, the forming wire is horizontal, as it passes by the flow openings.

3. A fiber distributor according to claim 1, wherein that two opposite partitions in a flow opening form an angle of between 5 and 35°.

4. A fiber distributor according to claim 3, wherein the two opposite partitions in a flow opening form an angle of between 10 and 25°.

5. A fiber distributor according to claim 1, wherein that each opening has a quadratic area.

6. A fiber distributor according to claim 1, wherein that each opening has a rectangular area.

7. A fiber distributor according to claim 1, wherein that two opposing sides of each opening extend mainly parallel with a transport direction of the forming wire.

8. A fiber distributor according to claim 1, wherein that two opposing sides of each opening form an angle with a transport direction of the forming wire.

9. A fiber distributor according to claim 1, wherein that the base is a grid having grid bars, each having two sides converging in a downwards direction and each forming a partition in a flow opening.

10. A fiber distributor according to claim 9, wherein that the height of each grid bar is between 1 and 5 times greater than its width at the upper side of the grid.

11. A fiber distributor according to claim 9, wherein that the crossed grid bars are joined at cross points by welding or soldering.

12. A fiber distributor according to claim 1, wherein that the base is coated with a fluorocarbon.

13. A fiber distributer apparatus comprising:

a fiber distributor housing having a fiber inlet and a base provided with a plurality of flow openings;

a plurality of rows of rotational wings positioned in the housing proximate to an upper side of the base and configured to distribute fibers along the upper side of the base;

a suction unit positioned across from a lower side of the base and configured to apply a suction; and an endless forming wire configured to pass by the flow openings, the endless forming wire being positioned between the lower side of the base and the suction unit; wherein the flow openings formed in the base are defined by partitions having angled sidewalls which diverge in a downward direction, such that the flow openings increase in cross-sectional area in the downward direction through a thickness of the base.

14. A fiber distributor according to claim 13, comprising a two-dimensional array of rotational wings positioned in the housing.

15. A fiber distributor according to claim 14, comprising three rows of rotational wings, each row having eight wings.

16. A fiber distributor according to claim 15, wherein each rotational wing is connected to a rotor via a shaft.

17. A fiber distributor according to claim 14, wherein the partitions are configured as a plurality of crossed grid bars which define the flow openings therebetween, each grid bar having a substantially trapezoidal shape including an upper side, a lower side and angled sidewalls extending between the upper side and the lower side, the upper side being wider than the lower side.

18. A fiber distributor according to claim 13, wherein the partitions are configured as a plurality of crossed grid bars which define the flow openings therebetween, each grid bar having a substantially trapezoidal shape including an upper side, a lower side and angled sidewalls extending between the upper side and the lower side, the upper side being wider than the lower side.

19. A fiber distributor according to claim 18, wherein, a height of each grid bar is between 1 and 5 times greater than its width at its upper side.

20. A fiber distributor according to claim 13, wherein the angled sidewalls form a non-zero angle with a transport direction of the forming wire.

* * * * *